United States Patent [19]

Harringer

[11] 4,420,879

[45] Dec. 20, 1983

[54] DEVICE FOR OPENING SNAP-LOCKED HOUSING SECTIONS OF A CABLE CONNECTOR

[75] Inventor: Robert V. Harringer, Joliet, Ill.

[73] Assignee: Western Electric Company, Inc., New York, N.Y.

[21] Appl. No.: 352,746

[22] Filed: Feb. 26, 1982

[51] Int. Cl.[3] ..... H01R 43/00

[52] U.S. Cl. ..... 29/764; 29/235; 29/253; 29/268; 29/426.6

[58] Field of Search ..... 29/764, 762, 426.6, 29/235, 253, 268

[56] References Cited

U.S. PATENT DOCUMENTS

| | | | |
|---|---|---|---|
| 3,157,075 | 11/1964 | Filia | 81/313 |
| 3,641,652 | 2/1972 | Arnold et al. . | |
| 4,290,193 | 9/1981 | Anderton et al. | 29/764 |
| 4,373,258 | 2/1983 | Hutchins | 29/764 |

*Primary Examiner*—Carl E. Hall

*Attorney, Agent, or Firm*—K. R. Bergum; R. P. Miller

[57] ABSTRACT

A manually operated device (10) adapted to facilitate the removal of a solderless type flat cable connector (15) from the terminated end of a flat cable (19) and, more particularly, to effect the release and pivotal separation of a first connector housing section (17) from a mating second housing section (18) normally snap-lock-secured thereto. The device (10) comprises a pair of pivotally connected, plier-like gripping members (21, 22) that are, in turn, respectively pivotally connected, as well as cross-coupled, to a pair of fixture-supporting gripping jaws (28, 34). As interconnected, the jaws advantageously move in parallel relationship in clamping a third connector housing section (16), fixedly secured to the second housing section (18), between two mutually disposed jaw-supported nesting blocks (42, 44), one (42) being mounted to the associated jaw (28) in a spring-biased manner. The jaw (28) with the spring-biased nesting block further supports cooperative fixturing in the form of a pair of laterally disposed blade members (52, 53), that project upwardly toward the opposing jaw, and an associated pair of similarly oriented, and spring-biased, drive pins (56, 57). The blade members (52, 53), when advanced in response to the clamping action of the jaws (28, 34), are adapted (through wedging action) to effect the snap-locked release of two laterally disposed U-shaped locking details (17*b'*, *c'*), formed in the first housing section (17), from two respectively associated outwardly tapered detents (18*b'*, *c'*), formed in the second housing section (17) of a clamped connector (15).

11 Claims, 7 Drawing Figures

FIG. 3
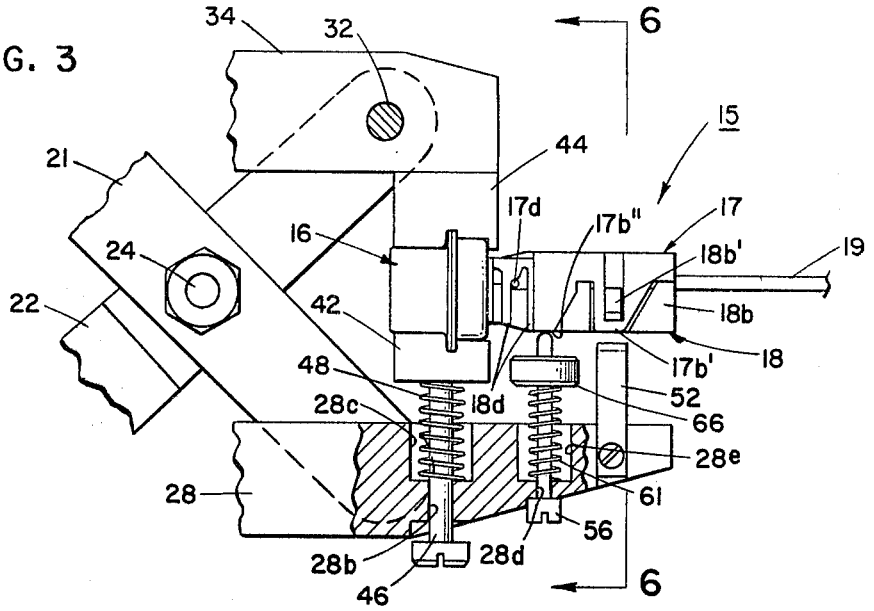
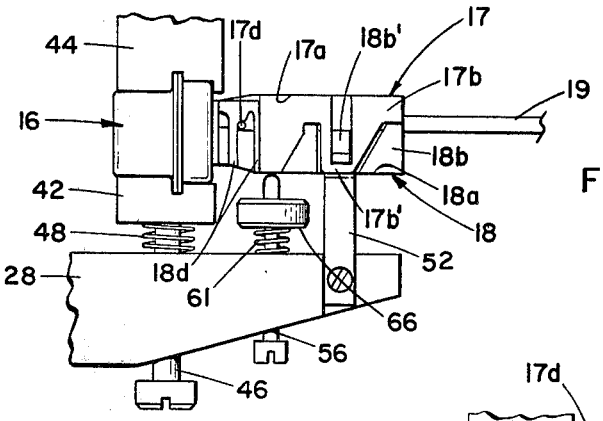
FIG. 4
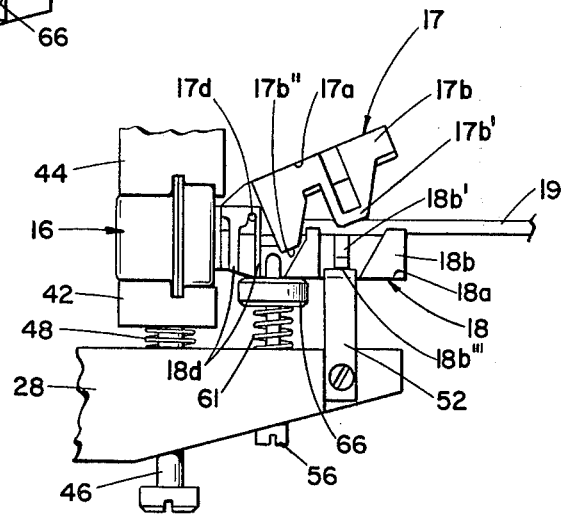
FIG. 5

FIG. 6
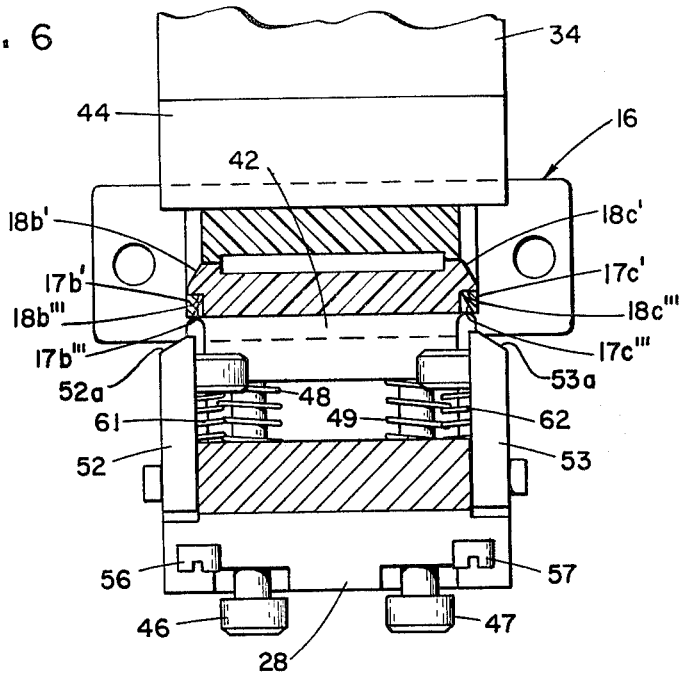
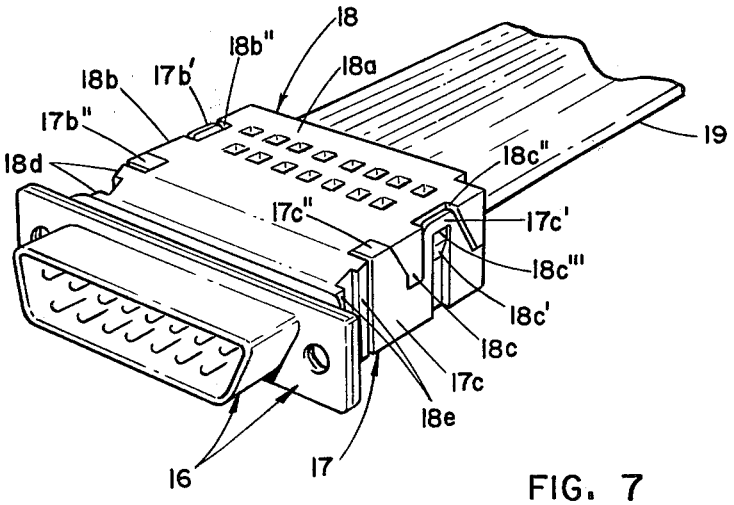
FIG. 7

DEVICE FOR OPENING SNAP-LOCKED HOUSING SECTIONS OF A CABLE CONNECTOR

FIELD OF THE INVENTION

This invention relates to a connector-opening device and, more particularly, to such a device of the manually operated gripping type that incorporates jaw-mounted fixturing adapted to effect the release and separation of one cable connector housing section from a mating section normally snap-lock-secured thereto.

BACKGROUND OF THE INVENTION

In the repair of connectorized multi-conductor flat cable, the connectors employed therewith, when of the solderless type, generally include two rearward mating (complementary) plastic housing sections, with either one or both sections supporting an array of contacts, and with one section being adapted to be snap-locked to the other section. When such cable housing sections are not interlocked, the releasable housing section is normally connected to the other section in a pivotal manner. The other housing section is generally secured to a forward metal housing portion of the connector that defines either a male or female end thereof.

In such a flat cable connector, each of the opposite sidewalls of the pivotally mounted and releasable housing section is typically formed with an integral and resilient U-shaped locking detail. Each locking detail is adapted to be deflected outwardly while sliding over an aligned one of two outwardly tapered protruding detents, each formed in a different sidewall of the stationary connector housing section, until the central opening of each locking detail snaps over the associated detent. At that point, the central leg portion of each locking detail firmly abuts against a protruding shoulder formed at the upper end of the associated tapered detent, to form a releasable latch.

The U-shaped locking details must be sufficiently stiff so as to prevent the accidental release of the two interlocked connector housing sections, while at the same time insuring that if the releasable housing section must be subsequently separated for repair purposes, for example, the locking details will not break off, or otherwise be impaired, particularly along the base regions of the leg portions thereof. In practice, the degree of stiffness that must be exhibited by the U-shaped locking details has made it very difficult for a repair person to manually grasp the connector in such a manner that not only both of the locking details are simultaneously deflected outwardly (by thumb or finger forces imparted thereagainst) sufficiently to release them from the previous respectively engaging detents, but to simultaneously impart opposed forces to the two then released housing sections so as to effect the desired separation therebetween.

Often compounding the difficulty of manually grasping and effecting the release and separation of such cable connector housings is their size. For example, in one particular type of connector applicable for use with a miniaturized flat cable having a single array of fifteen conductors, the two interlocked connector housing sections, together, measure only 15/16 inch in width, $\frac{3}{8}$ inch in thickness, and $\frac{7}{8}$ inch in depth.

Whenever a sharp instrumentality, such as a screwdriver, has been employed heretofore to facilitate the release and separation of two snap-locked cable connector housings of the type of particular concern herein, the inevitable non-uniform wedging forces exerted on each U-shaped locking detail, in succession, has often resulted in the details breaking off near the base of each integral leg portion thereof. Whenever this happens, of course, a new connector housing section must be employed in reconnectorizing a given cable. This not only involves additional appreciable expense, but requires a larger inventory of spare connector parts in the field. In addition, the utilization of any relatively sharp instrumentality, such as a screwdriver, in conjunction with finger-imparted forces to effect the release and separation of two cable connector housing sections, greatly increases the risk of accidental hand injury to the repair person.

There thus has been an urgent need for a relatively light, inexpensive and reliable hand-operated device applicable for use in the field, as well as in a manufacturing environment, to readily effect the opening of a cable connector of the type having two mating housing sections that are normally releasably interlocked by two laterally disposed sidewall latches. Considered more specifically, a device of the plier-like, handle actuated type has been particularly desired that would incorporate suitable jaw-supported fixturing adapted to initially reliably position and grip a latch-locked cable connector of the type of concern herein and, thereafter, sequentially effect: (1) the simultaneous release of the two laterally disposed connector latches, and (2) the physical separation of the released housing section from the previously mating section, with no supplemental hand/-finger imparted forces being required against the connector itself to effect the opening thereof.

There is disclosed in J. J. Anderton U.S. Pat. No. 4,290,193 a plier-like extractor tool that includes a pair of pivotal connector-gripping jaws and a separately actuated retractable latch-releasing member. The latter is mounted for retractable movement in a direction perpendicular to that of the jaws such that a forward wedge-shaped end of the retractable member can be independently brought into engagement with, and effect the release of, a single underside latch employed to fasten one particular type of connector to a support member, such as a printed circuit board. It is readily appreciated that such a tool is not applicable for use with flat cable connectors of the type in question, wherein two complementary (mating) connector housing sections are snap-locked together by two laterally disposed sidewall latches formed as integral parts thereof. Notwithstanding that fact, this prior tool also disadvantageously requires an operator to use one hand only to effect the actuation of the retractably mounted, single latch-releasing member thereof.

SUMMARY OF THE INVENTION

In accordance with the principles of the present invention, one preferred illustrative device for opening two snap-locked housing sections of a flat cable connector of the above-described type includes a pair of pivotally connected plier-like, handle-forming members that are, in turn, respectively pivotally connected, as well as cross-coupled, to a pair of fixture-supporting gripping jaws. As interconnected, the jaws advantageously move in parallel relationship (for reasons described in greater detail hereinbelow) to initially effect the clamping of a forward metal male (or female)-defining portion of the connector housing between two mutually disposed jaw-supported nesting blocks, one being mounted in a spring-biased manner.

The jaw with the spring-biased nesting block further supports cooperative fixturing in the form of a pair of laterally disposed wedging blade members, that project upwardly toward the opposing jaw, and an associated pair of similarly oriented, and spring-biased, drive pins. The blade members, in response to the clamping action of the jaws, are adapted to effect the release of two laterally disposed U-shaped locking details from two respectively associated outwardly tapered detents, in a cable connector of the above-described type, so as to allow the separation of the two normally interlocked connector housing sections, as assembled and connected to the terminated end of a cable.

The spring-biased pins are adapted to contact and exert a continuous upward force, with controlled upward displacement, on different opposite sidewall edges of the ultimately released connector housing section so as to effect the pivotal separation of the latter from the complementary section that remains secured to the forward metal housing portion of the connector. With the connector thus opened, an operator may readily either re-position any cable conductor(s) within the connector, to re-establish what might have been one or more defective cable conductor-connector contact interconnections, for example, or, alternatively, completely remove the connector from the terminated end of the cable so as to establish all new interconnections along a newly terminated end region of the cable, utilizing the same or a different connector.

It is thus seen that with a device of the type embodied herein, a repair person may very easily and precisely position a given connector between the jaw-supported fixturing of the device with one hand and, thereafter, by simply applying a small, but progressively increasing amount of compressive force between the handle portions of the device with the other hand, sequentially effect the release and separation of one cable connector housing section from a complementary housing section normally secured thereto, by means of two laterally disposed snap-locked type latches.

DESCRIPTION OF THE DRAWINGS

FIG. 3 is an enlarged, fragmentary detail side elevational view, partially in section, disclosing the positional relationship of the jaws and jaw-supported fixtures, in particular, of the device of FIG. 1, relative to an initially gripped connector;

FIG. 4 is an enlarged, fragmentary side elevational view similar to that of FIG. 3, but distinguishing therefrom by illustrating the positions of the jaw-supported fixtures relative to a gripped connector after the laterally disposed blade members of the device have been advanced into releasable wedging engagement with the respectively associated U-shaped locking details of the upper (as viewed) pivotally mounted connector housing section, while the spring-biased drive pins simultaneously engage and exert upward forces on lower sidewall edges of the same housing section;

FIG. 5 is an enlarged, fragmentary side-elevational view similar to that of FIG. 4, but distinguishing therefrom by illustrating the positions of the wedging blade members and drive pins mounted on the lower jaw member of the device of FIG. 1, relative to a gripped connector, after the upper (as viewed) housing section thereof has been released from the lower complementary housing section, and pivoted upwardly therefrom;

FIG. 6 is an enlarged end view, partially in section, of the device of FIG. 1, taken along the line 6—6 of FIG. 3, showing in greater detail the profile of the wedging blade members, and the positional relationship of the latter, as well as of the spring-biased drive pins, relative to the two releasably interlocked housing section of a jaw-gripped connector, and FIG. 7 is a perspective, and inverted, view of the flat cable connector depicted in FIG. 1, as secured to a terminated end portion of a flat cable, and illustrates in greater detail the construction of the two mating latch-secured connector housing sections that may be readily separated with a device embodying the principles of the present invention, as depicted in FIGS. 1–6.

DETAILED DESCRIPTION OF THE INVENTION

It should be understood that while the invention is described in detail herein relative to effecting the snap-locked (or latch-locked) release and separation of one housing section from a normally mating (or complementary) housing section in one particular type of solderless flat cable connector, the subject device also may have utility, with only minor dimensional and/or spacing modifications of the fixturing, in effecting a similar housing-opening operation on other related types of releasably interlocked connectors.

Figure 1:
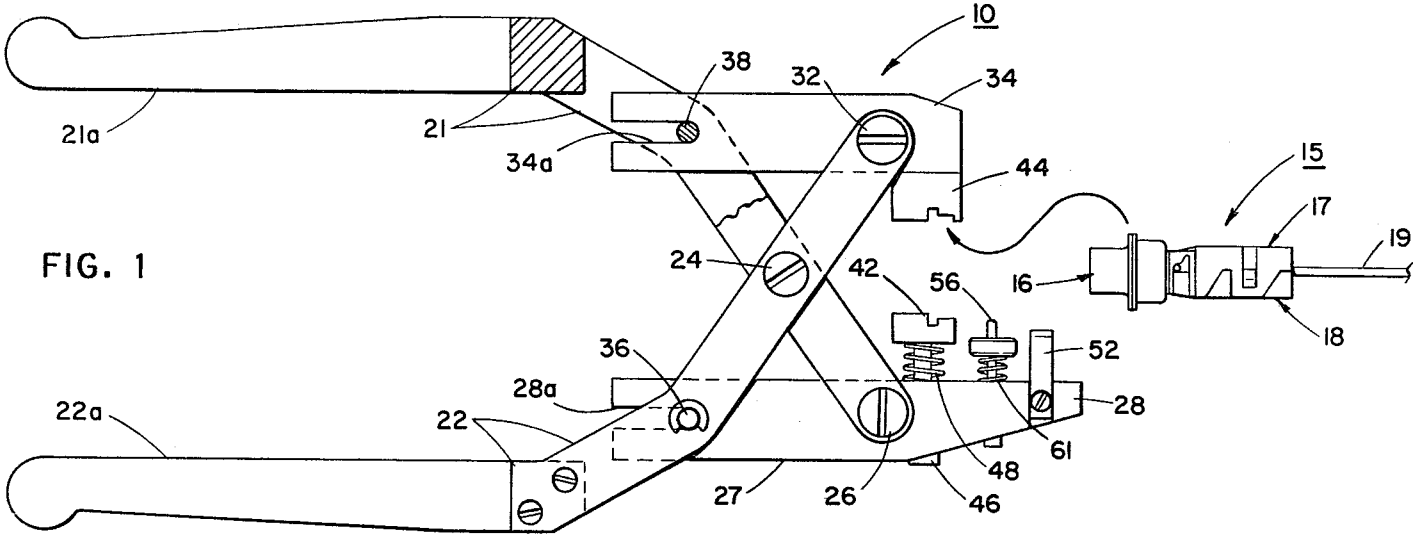
FIG. 1 is a side elevational view of a device embodying the principles of the present invention for opening normally snap-locked mating housing sections of a flat cable connector.

With particular reference first to FIGS. 1 and 7, there is shown a manually operated device 10 that is adapted to effect the opening of a flat cable connector 15, such as of the solderless type, best seen in FIG. 7. In order to more fully appreciate the purpose and function of the device 10, it will be helpful to briefly state at this point that the connector 15 includes a forward metal housing portion 16, that defines either a male or female end of the connector, and a rearward housing portion comprised of two mating (complementary) plastic sections 17 and 18. As assembled, it is the housing section 18, secured to the forward flanged portion 16, that normally incorporates bifurcated contacts (not shown) of the type adapted to effect solderless connections with the conductors (not shown) of a flat cable 19, so as to form a connectorized cable assembly. The upper housing section 17 is formed with a major intermediate planar wall 17*a*, and with two laterally disposed sidewalls 17*b* and *c* and, as illustrated in FIG. 5, is pivotally mounted on the mating (lower) housing section 18. The housing section 18 is similarly formed with an intermediate planar wall 18*a*, and with two laterally disposed sidewalls 18*b* and *c*.

As best seen in FIG. 7, wherein the connector 15 is inverted relative to the orientation thereof in the various other views, for purposes of greater clarity, a disposed pair of U-shaped locking details 17*b*′, 17*c*′, are respectively formed as integral parts of the opposite sidewalls 17*a* and *b*, of the upper housing section 17. Each of these details cooperates with an associated one of a pair of detents 18*b*′, 18*c*′ respectively formed as integral parts of the opposite sidewalls 18*a* and *b*, of the lower housing section 18, to form latches that releasably secure the two normally mating housing sections together. As illustrated, the detents 18*b*′, 18*c*′ are actually formed within respective vertically oriented recessed sidewall channels 18*b*'', 18*c*'' of the connector housing section 18.

As best seen in FIG. 6, the upper ends of the detents 18*b*', 18*c*' define respective outwardly protruding shoulders 18*b*''', 18*c*''', against which the underside surfaces of the central leg portions of the resilient U-shaped locking details 17*b*', 17*c*' respectively abut, after having been snapped thereover in response to the two complementary housing sections 17, 18 having been brought into firm mating relationship. In order to facilitate the release of the U-shaped locking details 17*b*', *c*', the center leg portion or each detail is formed with a beveled surface 17*b*''', 17*c*''' (seen only in FIG. 6). Further details of the construction and assembly of the connector 15 are not deemed necessary to an understanding of the device 10 embodied herein and, as such, it will suffice to simply say that a connector of the type illustrated herein is commercially available and sold under the tradename "AMP CHAMP," by the Amp Corporation.

Figure 2:
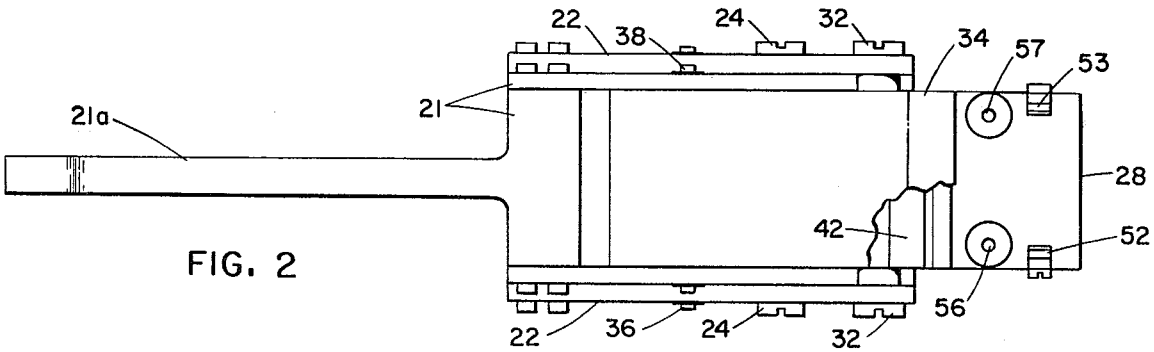
FIG. 2 is a plan view of the device of FIG. 1.

With particular reference now to FIGS. 1–3, the device 10 as embodied herein comprises a pair of mutually disposed plier-like gripping members 21, 22 that are pivotally connected by a suitable fastener 24, such as a threaded bolt or a pin, at corresponding points therealong nearer one end of each member than the other end thereof. As best seen in FIGS. 2 and 6, the gripping members 21, 22 are each bifurcated along short regions extending on either side of the common pivot point.

End regions 21*a* and 22*a* of the gripping members, furthest removed from their common pivot point, are configured to function as handle portions, with the length thereof, and the variable spacing therebetween, being chosen so as to allow such handle portions to be readily grasped by hand and, thereafter, manually displaced toward each other as required during a connector housing-opening operation described in greater detail hereinbelow.

The bifurcated end of the plier-like member 21 nearest the pivot point is coupled by a suitable threaded bolt or pin 26 to an elongated jaw 28 along an intermediate region of the latter. Similarly, the corresponding bifurcated end of the plier-like member 22 is pivotally connected by a threaded bolt or pin 32 to an opposiing elongated jaw 34 that is shorter in length than the jaw 28.

The rearward end region of the jaw 28 is formed with a key-way slot 28*a* that is adapted to receive a laterally disposed pin 36 which is secured to, and extends between, the bifurcated ends of the gripping member 22, along an intermediate region of the latter. Similarly, a rearward end region of the jaw 34 is formed with a key-way slot 34*a* that is adapted to receive a laterally disposed pin 38 which is secured to, and extends between, the bifurcated ends of the gripping member 21, along an intermediate region of the latter.

The exact location of the key-way guided pins 36, 38 are chosen relative to the respectively associated jaw-receiving slots 28*a* and 34*a* such that the jaws, in response to the pivotal movement of the gripping member handle portions 21*a* and 22*a*, move in related directions, but with the jaws continuously remaining parallel at all times. Such parallel movement of the gripping jaws is advantageous in not only insuring that a given connector 15, of the type depicted in FIG. 7, is initially precisely positioned and gripped, but in subsequently insuring that the connector housing section 17 is reliably and consistently released, and separated, from the normally mating housing section 18 by the controlled linear advancement of cooperative jaw-supported fixturing described in detail hereinafter.

To facilitate the reliable positioning of each gripped connector 15, the jaw 28 has an elongated spring-biased connector nesting block 42 mounted on the inner surface thereof, whereas the jaw 34 has an elongated nesting block 44 fixedly secured to the inner surface thereof. The nesting block 42, as best seen in FIGS. 3 and 6, is secured to the upper shank ends of a laterally disposed pair of headed support rods 46, 47 (both seen only in FIG. 6). The upper ends of these rods are preferably threaded so as to be adjustably received within corresponding tapped bores (not shown) formed in the underside of the nesting block 42. Each of the rods 46, 47 is retractably guided within an associated bore 28*b* (only one seen in FIG. 3) formed in the jaw 28, and is biased upwardly (as viewed) by a different coil spring 48 or 49 (the latter only seen in FIG. 6). Each spring is interposed between the lower surface of the nesting block 42, and the base of an associated oversized bore 28*c* (only one seen and in FIG. 3) that axially communicates with the associated bore 28*b*. With the nesting blocks 42 and 44 thus respectively mounted on the jaws 28 and 34, and with their opposed inner faces contoured so as to correspond with the respective mutually disposed mating metal surfaces of the forward connector housing portion 16 when interposed therebetween, accurate positioning of the connector is always assured.

In accordance with an aspect of the invention, the lower jaw 28 further includes along the forward end region thereof two additional composite fixtures, one of which comprises a pair of laterally disposed, and vertically oriented, spring-biased drive pins 56, 57. The other composite fixture comprises a pair of laterally disposed, and preferably adjustably mounted, latch releasing blade members 52, 53.

Each of the drive pins 56, 57 has an outer headed end and a shank portion that is retractably guided within an associated one of a pair of bores 28*d* (only one seen and in FIG. 3). Each of the drive pins is biased upwardly by means of an associated coil spring 61 or 62 (the latter only seen in FIG. 6) that is interposed between the underside of a knurled collar 66 or 67 and the base of an associated one of two oversized bores 28*e* (only one seen and in FIG. 3) formed in the jaw 28. The depth of each bore 28*e* is predetermined to allow only a portion of the associated coil spring 61 or 62 to normally be seated therewithin when the spring is not subjected to external compressive force. The collars 66 and 67 are preferably set-screw secured to the shank portions of the respective drive pins 56 and 57 so as to function as adjustable stops. The collars 66, 67 could, of course, be threadably mounted on the associated drive pins, if desired.

As adjustably mounted, each collar determines the degree of compression of the associated coil spring 61 or 62 prior to the housing section 17 of a gripped connector being released from the housing section 18 (see FIG. 4). Each collar 66, 67 also determines the length of that portion of the associated drive pin 56 or 57 that extends beyond the upper surface of the collar. It is this latter protruding portion of each drive pin that controls the amount of pivotal displacement of the upper housing section 17 when released from the lower complementary section 18 (see FIG. 5), described more fully hereinbelow in connection with a typical connector-opening operation.

With reference again to the latch-releasing blade members 52, 53, the upper ends thereof, as best seen in FIG. 6, are each formed with a beveled surface 52*a* or 53*a*. Each of these beveled surfaces cooperates with the aforementioned beveled surface 17*b*''' or 17*c*''', formed in the center leg portion of the associated one of the U-shaped locking details 17*b*' or 17*c*', so as to facilitate, by a wedging action, the release of each detail from the normally engaging one of the detents 18*b*' or 18*c*'.

A typical connector housing opening operation employing the device 10 as embodied herein will now be described. Such an operation is best understood with reference to FIGS. 3–5, considered in sequence. In FIG. 3, it is seen that the jaws 28 and 34 have been closed sufficiently, in response to a slight amount of compressive force having been manually exerted on the gripping member handle portions 21*a*, 22*a*, to allow the jaw-supported nesting blocks 42, 44 to resilient grip the forward metal housing portion 16 of the connector 15 therebetween. Also at that time, it is seen that the spring-biased drive pins 56, 57 are preferably axially dimensioned so that the upper ends thereof respectively contact lower sidewall edges 17*b*'', 17*c*'' (best seen in FIG. 7) of the pivotally mounted connector section 17, just prior to contact being made with the sidewall-formed latches of the connector by the blade members 52, 53.

Thereafter, in response to further compressive force being manually exerted on the gripping member handle portions 21*a*, 22*a* of the device 10, the extremities of each of the wedging blade members 52, 53, secured to a forward end region of the jaw 28, are progressively advanced until, as depicted in FIG. 4, they engage the respectively aligned U-shaped locking details 17*b*', *c*'. When fully advanced, the beveled end 52*a* or 53*a* of each blade member is completely wedged between the associated one of the U-shaped locking details 17*b*' or 17*c*', formed as an integral part of the pivotal housing section 17, and the mating base of the recessed sidewall channel 18*b*'' or 18*c*'', of the housing section 18. As previously noted, such wedging action is facilitated by the center leg portion of each of the U-shaped locking details 17*b*', 17*c*' of the connector 15, as fabricated, also normally being formed with respective cooperative beveled surfaces 17*b*''', 17*c*''' (seen only in FIG. 6).

In the illustrative embodiment of the device, the protruding shoulders of the detents 18*b*', *c*' function as positive stops for the terminated ends of the progressively advanced blade members 52 and 53, respectively. It becomes readily apparent, of course, that one or more adjustable stops (not shown) could be incorporated in the device 10 itself, if desired, to control not only the minimum spacing possible between the jaws 28, 34, while a connector 15 is clamped between the nesting blocks 42, 44, but the advancement of the blade members 52, 53 into engagement with the connector latches. For example, such stops could be in the form of one or more threaded screws mounted in associated tapped bores formed in the inner surface of the jaw 28, and located so as to terminate at a predetermined, adjustable elevation beneath the underside of the nesting block 42, thus controlling the compression of the coil springs 48, 49. Stop members in the form of washers or shims, of predetermined thickness, could also be coaxially mounted about either pair of coil springs 48, 49 or 61, 62 to accomplish the same result, if desired for a given application.

After the blade members 52, 53 have simultaneously deflected the respective U-shaped locking details 17*b*', 17*c*' outwardly sufficiently to release them from their respectively associated detents 18*b*', 18*c*', the simultaneously applied upward biasing forces exerted by the drive pins 56, 57 on the lower respective sidewall edges 17*b*'', 17*c*'' of the then released housing section 17, results in the latter being pivoted upwardly to the position depicted in FIG. 5. During such pivotal displacement, it is seen that the upper ends of the adjustable drive pins 56, 57 project upwardly into respective triangularly shaped recessed areas formed in the sidewalls of the connector housing section 18. These recessed areas, of course, are each formed to normally receive an associated complementary shaped sidewall portion of the housing section 17.

With the pivotal connector housing section 17 positioned as depicted in FIG. 5, it may thereafter be easily completely removed manually from the remaining portion of the connector, if desired, or required, for a particular cable conductor-connector contract repair operation. With respect to the illustrative connector 15, complete removal of the housing section 17 is accomplished by further pivoting the latter upwardly, from the position depicted in FIG. 5, until two laterally disposed pins 17*d* (only one seen), formed as integral parts of the sidewalls 17*b* and *c*, are released from different normally confining arcuate open areas defined within resilient U-shaped flanges 18*d* and *e* (the latter seen only in FIG. 7), formed as integral parts of the housing section 18. This, in turn, releases a turned-up (L-shaped) bifurcated boss (not shown), formed along the rearward edge of the connector housing section 17, from a laterally disposed receiving slot defined, in part, by the adjacent laterally disposed, and turned-down, edge of the metal connector housing portion 16. Such complete removal of the pivotally mounted housing section 17 may be accomplished either before or after the connector has been released from the jaw-supported nesting blocks 42, 44.

With respect to the opening of the jaws 28, 34, the biasing forces of the coil springs 48, 49 and 61, 62 are normally sufficient to effect the release of a gripped connector 15, with only a slight additional separation of the gripping member handle portions 21*a* and 22*a* possibly being required to completely free the flanged portion of the housing section 16 from the nesting blocks 42, 42. It is readily apparent, of course, that the gripping member handle portions 21*a*,22*a* and, alternatively, the gripping jaws 28, 34, could be normally biased apart to a fully opened position, as depicted in FIG. 1, if desired, by a suitable coil spring (not shown), for example, being selectively interposed therebetween.

As previously noted, the dimensions and spacings of the jaw-supported fixtures, in particular, as embodied in the device 10, can be readily modified so as to be compatible with many other related types of connectors of various sizes utilizing sidewall-formed, snap-locked latches of the general type incorporated in the illustrative connector. It is also obvious, that the point in time during the operation of the device 10 at which the wedging blade members 52, 53, and drive pins 56, 57, initially contact different areas of the releasable housing section of a gripped connector, as well as the amount of displacement imparted to such fixtures to effect the opening of the mating housing sections, may be readily adjusted for any given application.

While a preferred device for effecting the release and separation of two interlocked connector housing sections of a connector, as secured to a cable, has been disclosed herein, it is obvious that various modifications may be made to the present illustrative claimed embodiment of the invention, and that a number of alternative related embodiments could be devised by one skilled in the art without departing from the spirit and scope of the invention.

What is claimed is:

1. A device for releasing and separating a first housing section from a second housing section of a cable connector, wherein the first and second housing sections are normally releasably secured together by a pair of laterally spaced, sidewall-located snap-locked latches, and wherein the second housing section is fixedly secured to a third housing section, said device comprising:

first and second pivotally connected handle-defining gripping members;

first and second jaw means respectively connected to said first and second gripping members, said jaw means, in response to a compressive force manually exerted on the handle portions of said gripping members, acting to precisely position and resiliently clamp the third housing section of a connector when interposed therebetween;

first and second laterally disposed latch-releasing members mounted on one of said first and second jaw means, each of said latch-releasing members being positioned, and having a terminated end acting to engage and effect the release of a different one of the latches of a clamped connector, and biasing means mounted on the same one of said first and second jaw means as said latch releasing members, said biasing means being positioned so as to contact and effect the displacement of the first connector housing section, when released, a predetermined distance from the second housing section.

2. A device in accordance with claim 1 wherein said first and second jaw means each includes a clamping portion having an inner surface that is configured to nest a different one of two mutually disposed and contoured surfaces of the third connector housing section when the latter is clamped between said clamping portions, with at least one of the latter being resiliently biased in the direction of a clamped connector.

3. A device in accordance with claim 2 wherein each of said first and second jaw means is formed with a key-way, and wherein each of said first and second gripping members includes a laterally disposed guide pin, with the pins in said first and second gripping members being positioned so as to be received in the keyways of said second and first jaw means, respectively, such that said first and second jaw means move in parallel relationship toward and away from each other in response to the related, but pivotal, movement of the handle portions of said gripping members.

4. A device in accordance with claim 1 wherein each of said first and second latch-releasing members is of blade-like configuration, and formed with a beveled surface at the outer end thereof so as to facilitate a wedging action when advanced into engagement with the associated latch of a clamped connector, wherein said biasing means comprises a laterally disposed pair of spring-biased drive pins, and wherein an adjustable collar is mounted on each of said drive pins for controlling the amount of upward displacement imparted to the first releasable housing section relative to the second housing section of a clamped connector.

5. A device in accordance with claim 4 wherein each of said first and second jaw means is formed with a key-way, and wherein each of said first and second gripping members includes a laterally disposed guide pin, with the pins in said first and second gripping members being positioned so as to be received in the keyways of said second and first jaw means, respectively, such that the pivotal displacement of said first and second gripping members, as cross-coupled to said first and second jaw means, effects related displacement of both of said jaw means, but with the latter moving in parallel relationship.

6. A device in accordance with claim 2 wherein at least the one of said jaw means-clamping portions associated with the one of said first and second jaw means that supports said first and second latch-releasing members, is retractably mounted and upwardly biased in the direction of a clamped connector.

7. A device in accordance with claim 5 wherein each of said first and second jaw means includes a clamping member, with the inner facing surface of each clamping member being configured to nest a different one of two mutually disposed and major surfaces of the third connector housing section when the latter is properly positioned and subsequently clamped between said clamping members, and wherein at least said clamping member associated with the one of said first and second jaw means that supports said first and second latch-releasing members, is retractably mounted and upwardly-biased in the direction of a clamped connector.

8. A device for releasing and separating a first housing section from a normally snap-lock-secured second housing section of a connector, as the latter is assembled and connected to a cable, wherein such housing securement is effected by each of opposite sidewalls of the first housing section being formed with a resilient, U-shaped integral locking detail, with the latter being adapted to releasably engage an associated one of two protruding detents respectively and integrally formed in different opposite sidewalls of the second housing section, said opposite sidewall-formed U-shaped details and detents thus forming releasable latches, and wherein the second housing section is fixedly secured to a third housing section of the connector, said device comprising:

first and second pivotally connected gripping members, each of said members forming a handle portion on one side and a jaw means-actuating portion on the opposite side of of the pivot point thereof;

first and second jaw means respectively pivotally connected to the actuating portions of said first and second gripping members, and being cross-coupled to the one of said first and second gripping members not pivotally coupled thereto, such that said first and second jaw means move in parallel relationship toward and away from each other in response to the related, but pivotal movement of said handle portions of said gripping members, each of said jaw means further including a clamping member, with the inner facing surface of each clamping member being configured to nest a different one of two mutually disposed and major surfaces of the third connector housing section when properly positioned, and subsequently clamped, between said clamping members;

first and second laterally disposed latch-releasing members mounted on said second jaw means, each of said releasing members being of blade-like configuration, and having an upper end positioned and acting to engage and effect the release of an associated one of the U-shaped locking details from the respectively associated and normally engaging detent of a connector, when the third housing portion of the latter is clamped between said clamping members such that the second connector housing section is facing said second jaw means, and first and second spring-biased drive pins laterally disposed and retractably mounted on said second jaw means, said drive pins being biased in the direction of a clamped connector, and positioned to respectively contact different sidewall edges of the first releasable connector housing section so as to urge the latter away from the normally mating second housing section, at least at the point in time when said connector latches are released, in response to the advancement of said releasing members into respective engagement therewith.

9. A device in accordance with claim 8 wherein at least said clamping member of said second jaw means is retractably mounted and upwardly biased in the direction of a clamped connector, and wherein each of said first and second jaw means is formed with a key-way, and wherein each of said first and second gripping members is bifurcated at the actuating end thereof, and includes a laterally disposed, interconnecting guide pin, with the pins in first and second gripping members being positioned so as to be received in the key-ways of said second and first jaw means, respectively, to establish said cross-coupled connections that allow said first and second jaw means to move in parallel relationship.

10. A device in accordance with claim 8 wherein each of said first and second releasing members is of blade-like configuration, and formed with a beveled surface at the outer end thereof so as to facilitate a wedging action when advanced into engagement with the associated one of the two latch-forming U-shaped locking details of a clamped connector, and wherein an adjustable collar is mounted on each of said drive pins for controlling the amount of upward displacement imparted to the first housing section, when released, relative to the second housing section of a clamped connector.

11. A device in accordance with claim 10 wherein at least one of said clamping members of said jaw means is retractably mounted and upwardly biased in the direction of a clamped connector, and wherein each of said first and second gripping members is bifurcated at the actuating end thereof, and includes a laterally disposed, interconnecting guide pin, with the pins in said first and second gripping members being positioned so as to be received in the key-ways of said second and first jaw means, respectively, to establish said cross-coupled connections that allow said first and second jaw means to move in parallel relationship.

* * * * *